US009336704B2

(12) United States Patent
Li et al.

(10) Patent No.: US 9,336,704 B2
(45) Date of Patent: May 10, 2016

(54) APPARATUS AND METHOD FOR POWERING LED DRIVER

(71) Applicant: SCT TECHNOLOGY, LTD., Grand Cayman (KY)

(72) Inventors: Eric Li, Milpitas, CA (US); Yi Zhang, Milpitas, CA (US)

(73) Assignee: SCT TECHNOLOGY, LTD., Grand Cayman (KY)

( * ) Notice: Subject to any disclaimer, the term of this patent is extended or adjusted under 35 U.S.C. 154(b) by 105 days.

(21) Appl. No.: 14/058,210

(22) Filed: Oct. 18, 2013

(65) Prior Publication Data

US 2015/0109190 A1 Apr. 23, 2015

(51) Int. Cl.

| | |
|---|---|
| ***G09G 3/32*** | (2006.01) |
| ***G09G 3/34*** | (2006.01) |
| *H05B 33/08* | (2006.01) |

(52) U.S. Cl.

CPC ..... *G09G 3/32* (2013.01); *G09G 3/3426* (2013.01); *G09G 2310/0264* (2013.01); *H05B 33/0809* (2013.01)

(58) Field of Classification Search

CPC ..... G09G 3/32; H05B 33/0815

USPC ..... 345/73–84, 204–215, 690–699; 315/169.1–169.4

See application file for complete search history.

(56) References Cited

U.S. PATENT DOCUMENTS

| | | | | |
|---|---|---|---|---|
| 2010/0237696 | A1* | 9/2010 | Maleyran et al. | 307/24 |
| 2011/0285321 | A1* | 11/2011 | Li et al. | 315/307 |
| 2012/0327129 | A1* | 12/2012 | Li et al. | 345/690 |
| 2014/0128941 | A1* | 5/2014 | Williams | A61N 5/06 607/88 |

* cited by examiner

*Primary Examiner* — Kent Chang
*Assistant Examiner* — Scott Au
(74) *Attorney, Agent, or Firm* — Novick, Kim & Lee, PLLC; Allen Xue

(57) ABSTRACT

A driver circuit for an LED display panel has a first constant current driver to drive green LEDs, a second constant current driver to drive blue LEDs, and a third constant current driver to drive red LEDs. The driver circuit also has an analog power module electrically coupled to the first, the second, and the third constant current drivers. The analog power module has two or more power sources. The driver circuit further includes a digital controller for transmitting digital control signals to the analog driver. The digital controller is powered by a digital power module.

9 Claims, 3 Drawing Sheets

Figure 1:
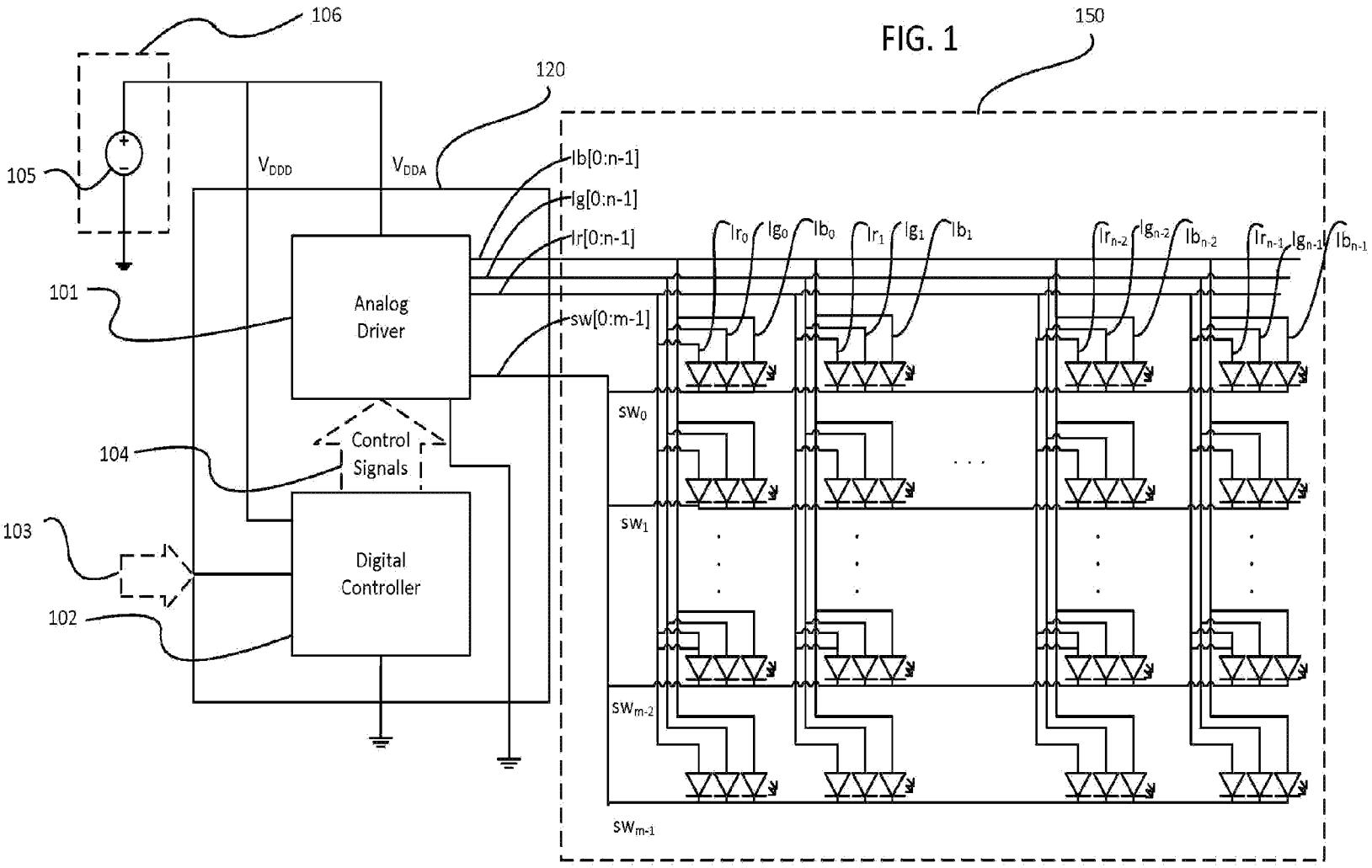

350
320
330
340
Ib[0:n-1]
Ig[0:n-1]
Ir[0:n-1]
sw[0:m-1]
$V_{DDB}$
$V_{DDG}$
$V_{DDR}$
$V_{DDD}$
Analog Driver
Control Signals
Digital Controller
301
302
303
304
305
306
307
$Ib_{n-1}$
$Ig_{n-1}$
$Ir_{n-1}$
$Ib_{n-2}$
$Ig_{n-2}$
$Ir_{n-2}$
$Ib_1$
$Ig_1$
$Ir_1$
$Ib_0$
$Ig_0$
$Ir_0$
$SW_0$
$SW_1$
$SW_{m-2}$
$SW_{m-1}$

APPARATUS AND METHOD FOR POWERING LED DRIVER

TECHNICAL FIELD

The present disclosure relates generally to devices, circuits, and methods for driving light emitting diode (LED) display panels. More particularly, the present disclosure relates to devices, circuits, and methods for driving the LED display panels, so as to enhance power supply efficiency, to increase LED driver circuitry integration and to reduce heat dissipation.

BACKGROUND

In recent years, devices and applications involving LEDs (i.e., light emitting diodes) are gaining popularity. Such devices and applications range from light sources for general illumination, signs and signals, to display panels, televisions, etc. Regardless of the applications, LED driver circuits are used in supplying power to the LEDs.

An LED panel refers to a device that includes an array of LEDs that are connected together, or a device that includes plurality of sub-modules, each sub-module having such an LED array. LED panels usually employ arrays of LEDs of a single color or different colors. When individual LEDs are used in certain display applications, each LED usually represents a display pixel. An RGB LED unit refers to a cluster of three LEDs, namely, a red LED, a green LED, and a blue LED. When RGB LED units are used in certain display applications, each RGB LED unit may represent a display pixel. Surface mounted RGB LED units usually have four pins, one pin for each of the red, green, and blue LEDs and the fourth pin for either a common anode or a common cathode.

LED arrays are traditionally arranged in a common anode scan configurations, in which the anode of the LEDs are electronically connected to a power source via a switch element, while the cathodes of the LEDs are electronically connected to the output of current sink. In such a configuration, an N-MOS driver is often used as the current sink. An N-MOS is preferable over a P-MOS because N-MOS has a larger current capacity and a lower RDS (on) for a given design configuration.

In a common anode configuration, all RGB LEDs are connected to the same power supply and are supplied the same voltage. As is well-known in the art, the red LED forward voltage is significantly lower than that of green and blue LEDs. If the same supply voltage is used for the red, green, and blue LEDs, adjustments are required to match the forward voltages of individual LEDs, for example, by installing a bias resistor between the power supply and the LED. In that case, a significant amount of energy is dissipated as heat on the bias resistor. For example, if the supply voltage is 5 volts, since the forward voltage drop of a red LED is about 2.0 volts, approximately 60% of the energy is lost as heat on the bias resistor. Excessive heat dissipation wastes energy and complicates the design of driver circuitry because extra consideration needs to be given to increased demand of heat removal.

In addition, the display resolution increases when the size of the pixel pitch becomes smaller. The size of the pixel pitch is partially determined by the printed circuit board that holds a variety of components. Such components are, for example, a constant current driver, a decoder, power MOSFETs to control scan line switching, and bias resistors for some LEDs (such as red LEDs) to reduce LED driver operating voltage. In a design that these components are mounted on a PCB (printed circuit board) as discrete parts, the number of layers on a PCB needs to be increased. Such a design increases manufacturing cost as well as the difficulties in both noise reduction and pixel patch size reduction. In such a design with discrete parts, other problems may arise, such as timing control, parasitic capacitance, and ghost images, etc.

There is a need to design a highly integrated LED driving circuit with reduced cost, reduced heat dissipation, and reduced noise, which is capable of driving high resolution LED displays.

SUMMARY OF INVENTION

In one embodiment, there is provided a driver circuit for an LED display panel. The circuit comprises an array of R/G/B LEDs arranged in a common cathode configuration; an analog driver which comprises a first constant current driver to drive green LEDs, a second constant current driver to drive blue LEDs, and a third constant current driver to drive red LEDs; an analog power module electrically coupled to the first, the second, and the third constant current drivers, the analog power module further comprises a first power source and a second power source; and a digital controller for transmitting digital control signals to the analog driver. The digital controller is powered by a digital power module.

In another embodiment, there is provided a method for powering LED display panels. The method comprises powering an analog driver using an analog power module, the analog power module comprises a first power source and a second power source; and powering a digital controller using a digital power module, the digital controller transmits digital control signals to the analog driver.

In another embodiment, there is provided an LED display system. The display system comprises an LED array arranged in a common cathode configuration; an analog driver that provides a constant current to drive the LED array; a digital controller for transmitting digital signal to the analog driver. The digital controller is powered by an internal low-dropout regulator residing on the chip, and the analog driver is powered by a first power source and a second power source.

DESCRIPTIONS OF DRAWINGS

The teachings of the present disclosure can be readily understood by considering the following detailed description in conjunction with the accompanying drawings.

FIG. 1 schematically illustrates the traditional LED array power scheme, in which a digital controller and an analog driver share the same power module.

Figure 2:
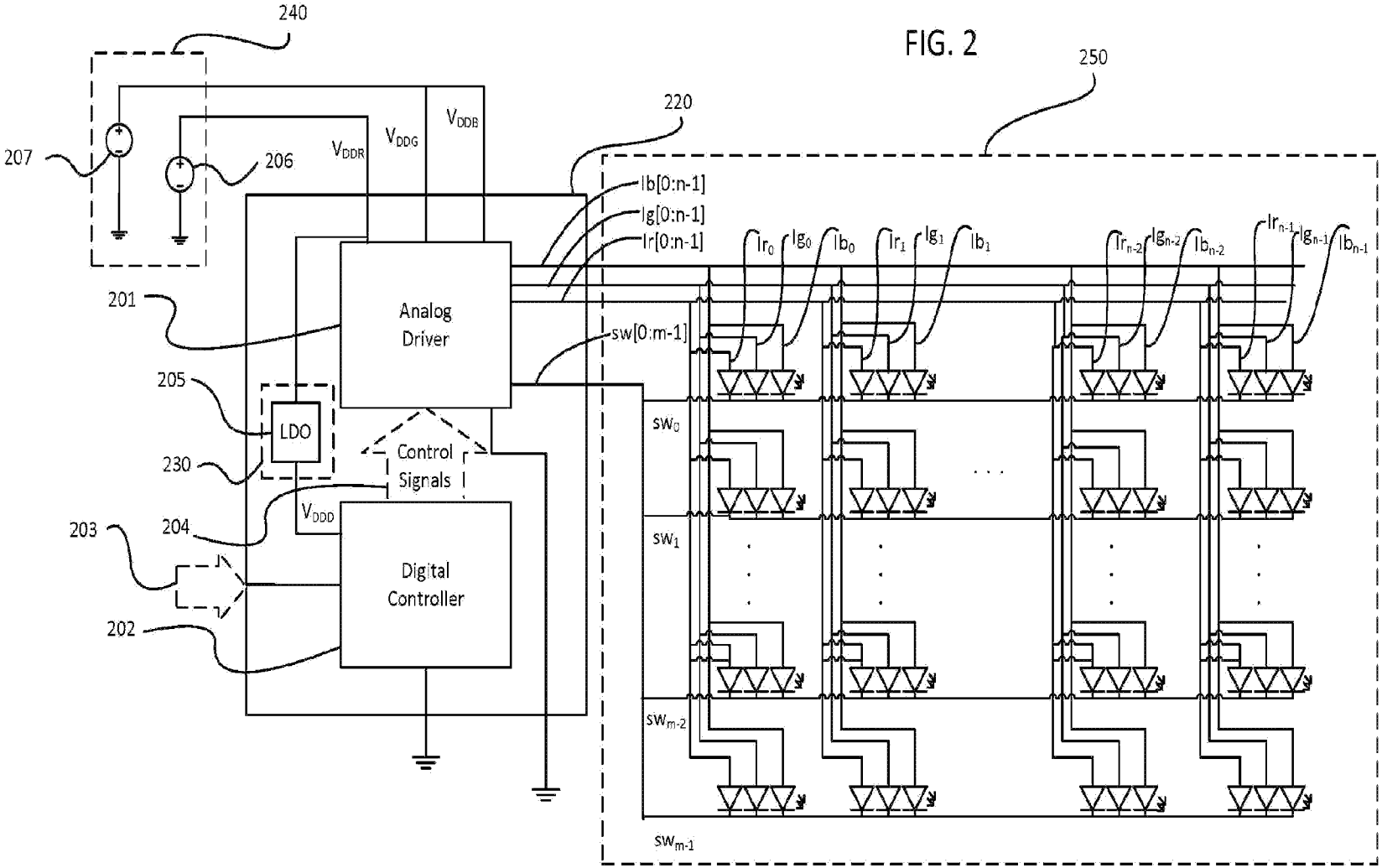

FIG. 2 schematically illustrates an LED array power scheme according to one embodiment of the present disclosure, in which a digital power module and an analog power module are separate, with digital power module powered by an internal low dropout (LDO) regulator power source.

Figure 3:
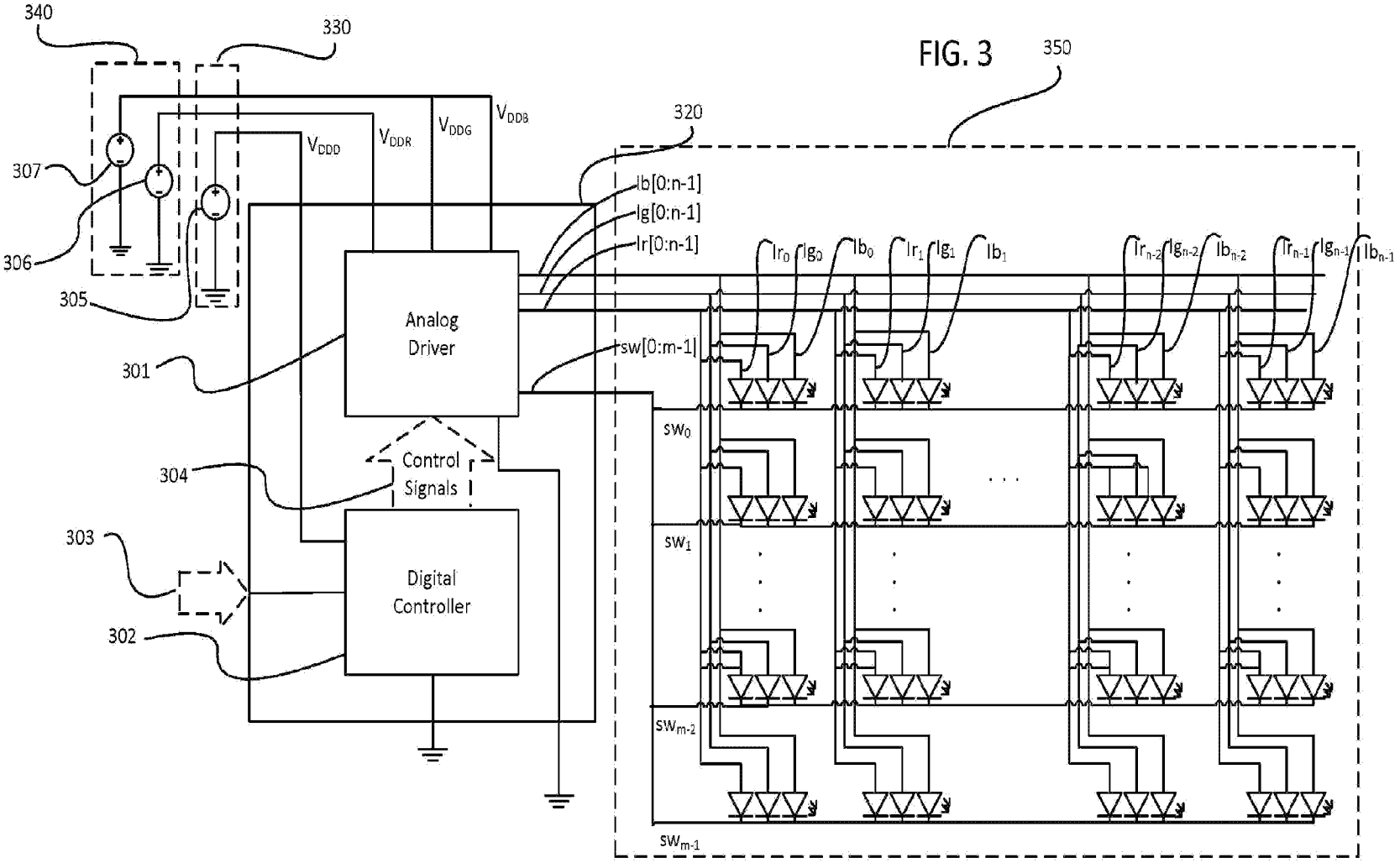

FIG. 3 schematically illustrates an LED array power scheme according to one embodiment of the present disclosure, in which a digital power module and an analog power module are separate, with digital power module powered by an external digital power source.

DETAILED DESCRIPTION OF THE EMBODIMENT

The Figures (FIG.) and the following description relate to the embodiments of the present disclosure by way of illustration only. It should be noted that from the following discussion, alternative embodiments of the structures and/or methods disclosed herein will be readily recognized as viable alternatives that may be employed without departing from the principles of the claimed inventions.

Reference will now be made in detail to several embodiments of the present disclosure(s), examples of which are illustrated in the accompanying figures. It is noted that wherever practicable similar or like reference numbers may be used in the figures and may indicate similar or like functionality. The figures depict embodiments of the present disclosure for the purposes of illustration only. One skilled in the art will readily recognize from the following description that alternative embodiments of the structures and methods illustrated herein may be employed without departing from the principles of the disclosure described herein.

FIG. 1 schematically illustrates the traditional LED array power scheme, in which the digital controller and the analog driver share the same power module. LED array 150 includes an array of R/G/B LEDs arranged in common cathode configuration. There are n columns and m rows of R/G/B LEDs. The columns are columns 0 through n−1. The rows are row 0 through row m−1.

The driver controller chip 120 includes an analog driver 101 and a digital controller 102. A digital control signal source 103 is transmitted to the digital controller 102, from which a control signal 104 is transmitted to the analog driver 101. Digital voltage $V_{DDD}$ is coupled to the digital controller while analog voltage $V_{DDA}$ is coupled to the analog driver. The analog driver includes a plurality of constant current drivers, Ib[i] is constant current driver for the ith column blue LED, i is 0 through n−1, Ig[i] is constant current driver for the ith column green LED, i is 0 through n−1, Ir[i] is constant current driver for the ith column red LED, i is 0 through n−1. The analog driver also includes a plurality of switches, sw[j] is the switch for the jth row R/G/B LEDs. In the traditional scheme, $V_{DDD}$ and $V_{DDA}$ are both supplied by same power module 106. The power module 106 has a single power source 105.

In the common cathode configuration as depicted in FIG. 1, for the R/G/B LED of xth column and yth row, the anodes of the red, green and blue LEDs are electronically coupled to constant current drivers Ib[x], Ig[x], and Ir[x] respectively located inside the analog driver 101. The common cathodes of the red, green and blue LEDs are electronically coupled to the switch sw[y] located inside the analog driver 101.

In the embodiment of FIG. 2, the analog driver 201 is powered by an analog power module 240, which includes a red power source 206 (i.e., the power source for the red LEDs), and a blue green power source 207 (i.e., the power source for the blue and green LEDs). The digital controller 202 is powered by a separate digital power module 230, which includes a low dropout regulator (LDO) 205. An LDO is a DC linear voltage regulator that can operate with a very small input-output differential voltage.

In this embodiment, the LED array module 250 includes an array of R/G/B LEDs arranged in the common cathode configuration. The driver controller chip 220 comprises an analog driver 201 and a digital controller 202. A digital control signal 203 source is transmitted to digital controller 202, which generates control signals for the analog driver 201.

$V_{DDB}$, $V_{DDG}$, and $V_{DDR}$ are voltages for blue LEDs, green LEDs, and red LEDs, respectively. $V_{DDB}$ and $V_{DDG}$ are connected to power source 207 and have a higher voltage, e.g., approximately 3.8V, while $V_{DDR}$ is connected to power source 206 and has a lower voltage, e.g., approximately 2.8V. Alternatively, $V_{DDB}$ and $V_{DDG}$ can be supplied by two different power sources.

The $V_{DDR}$ is coupled to the LDO 205 and through which supplies the digital controller 202 with a voltage, for example, 1.8V or lower. A lower $V_{DDD}$ provides better power consumption efficiency because power consumption of the digital parts is significant. The dynamic power consumed by the digital parts is proportional to $C \cdot V^2 \cdot f$: $P = C \cdot V^2 \cdot f$, where C is a constant.

The analog driver includes a plurality of constant current drivers, Ib[i] is constant current driver for the ith column blue LED, i is 0 through n−1, Ig[i] is constant current driver for the ith column green LED, i is 0 through n−1, Ir[i] is constant current driver for the ith column red LED, i is 0 through n−1. The analog driver also includes a plurality of switches, sw[j] is the switch for the jth row R/G/B LEDs.

FIG. 3 depicts a further embodiment of the present disclosure. In this embodiment, the LED array module 350 includes an array of R/G/B LEDs in common cathode configuration. Similar to the embodiment in FIG. 2, the driver controller chip 320 also comprises an analog driver 301 and a digital controller 302. A digital control signal source 303 is transmitted in to the digital controller 302, which generates control signals for the analog driver 301. Furthermore, the analog driver 301 is powered by two power sources 306 and 307. The voltage $V_{DDR}$ for red LEDs is supplied by the power source 306, $V_{DDG}$ for green LEDs and $V_{DDR}$ for blue LEDs are supplied by the power source 307. However, different from the embodiment in FIG. 2, the digital controller 302 is powered by a separate external power source 305, which supplies a voltage $V_{DDD}$ to the digital controller. The power source 305 is a part of the external digital power module 330.

The analog driver 301 includes a plurality of constant current drivers, Ib[i] is constant current driver for the ith column blue LED, i is 0 through n−1, Ig[i] is constant current driver for the ith column green LED, i is 0 through n−1, Ir[i] is constant current driver for the ith column red LED, i is 0 through n−1. The analog driver 301 also includes a plurality of switches, sw[j] is the switch for the jth row R/G/B LEDs.

Embodiments of the present disclosure have been described in detail. Other embodiments will become apparent to those skilled in the art from consideration and practice of the present disclosure. Accordingly, it is intended that the specification and the drawings be considered as exemplary and explanatory only, with true scope of the present disclosure being set forth in the following claims.

What is claimed:

1. A driver circuit for an LED display panel, comprising:

an LED driver controller chip comprising:

an analog driver comprising:

a first constant current driver to drive green LEDs, a second constant current driver to drive blue LEDs, and a third constant current driver to drive red LEDs, a digital controller for transmitting digital control signals to the analog driver, and a low-dropout regulator electrically coupled to the digital controller and being an internal component of the LED driver controller chip; and an analog power module electrically coupled to the first, the second, and the third constant current drivers, the analog power module comprising:

a first power source configured to provide a first voltage to the first and the second constant current drivers, and a second power source directly coupled to the third constant current driver for driving drive red LEDs, and configured to provide a second voltage to the third constant current driver, wherein the low-dropout regulator is branched off from a connection between the second power source and the third constant current driver, wherein the low-dropout regulator is configured to receive the second voltage and to supply the third voltage to the digital controller, wherein when the second power source directly provides the second voltage to the third constant current driver, the low-dropout regulator is configured to provide the third voltage to the digital controller at the same time, and wherein the first voltage is higher than the second voltage, the second voltage is higher than the third voltage.

2. The driver circuit of claim 1, wherein the green LEDs, the blue LEDs, and the red LEDs are arranged in a common cathode configuration.

3. The driver circuit of claim 1, wherein the first power source comprises a first power supply device and a second power supply device, which are coupled to the first and the second constant current drivers, respectively.

4. The driver circuit of claim 1, wherein the first power source supplies a power ranging from 2.6V to 3.6V, and the second power source supplies a power ranging from 1.8V to 2.4V.

5. The driver circuit of claim 1, wherein the first voltage is about 3.8 V, the second voltage is about 2.8V, and the third voltage is about 1.8V.

6. A method for powering an LED display panel, the method comprising:

powering an analog driver using an analog power module, wherein the analog power module comprises a first power source and a second power source and wherein the analog driver comprises:

a first constant current driver for driving green LEDs, a second constant current driver for driving blue LEDs, and a third constant current driver for driving red LEDs;

providing a first voltage from the first power source to the first and the second constant current drivers;

providing a second voltage from the second power source to the third constant current drivers;

powering a digital controller using a digital power module by providing a third voltage to the digital controller;

at a low-dropout regulator, receiving the second voltage and reducing the second voltage to the third voltage, and outputting the third voltage to the digital controller; and transmitting digital control signals from the digital controller to the analog driver, wherein the low-dropout regulator is branched off from a connection between the second power source and the third constant current driver, wherein the low-dropout regulator is configured to receive the second voltage and to supply the third voltage to the digital controller, wherein when the second power source directly provides the second voltage to the third constant current driver, the low-dropout regulator is configured to provide the third voltage to the digital controller at the same time, and wherein the first voltage is higher than the second voltage, the second voltage is higher than the third voltage.

7. The method of claim 6, wherein the first power source supplies power ranging from 2.6V to 3.6V, and the second power source inside the analog power module supplies power ranging from 1.8V to 2.4V.

8. The method of claim 6, wherein the first voltage is about 3.8 V, the second voltage is about 2.8V, and the third voltage is about 1.8V.

9. The method of claim 6, wherein the first power source comprises a first power supply and a second power supply, which are coupled to the first and the second constant current drivers, respectively.

* * * * *